US011761731B2

(12) United States Patent
Niswander et al.

(10) Patent No.: US 11,761,731 B2
(45) Date of Patent: Sep. 19, 2023

(54) SYSTEMS AND METHODS FOR ALTERNATING SIGHT ADAPTORS PLATES AND ASSOCIATED ACCESSORIES

(71) Applicant: AGENCY ARMS, LLC, Ventura, CA (US)

(72) Inventors: Randy Paul Niswander, Oxnard, CA (US); Michael Lee Parks, Canyon Country, CA (US)

(73) Assignee: AGENCY ARMS, LLC, Caldwell, ID (US)

( * ) Notice: Subject to any disclaimer, the term of this patent is extended or adjusted under 35 U.S.C. 154(b) by 138 days.

(21) Appl. No.: 17/381,761

(22) Filed: Jul. 21, 2021

(65) Prior Publication Data

US 2021/0348882 A1 Nov. 11, 2021

Related U.S. Application Data

(63) Continuation of application No. 16/861,813, filed on Apr. 29, 2020, now Pat. No. 11,112,214.

(60) Provisional application No. 62/877,520, filed on Jul. 23, 2019.

(51) Int. Cl.

| | |
|---|---|
| ***F41G 1/16*** | (2006.01) |
| ***F41G 11/00*** | (2006.01) |
| ***F41G 1/30*** | (2006.01) |
| ***F41G 1/02*** | (2006.01) |

(52) U.S. Cl.

CPC ..... *F41G 1/16* (2013.01); *F41G 1/02* (2013.01); *F41G 1/30* (2013.01); *F41G 11/001* (2013.01)

(58) Field of Classification Search

CPC ..... F41G 11/00; F41G 11/001; F41G 11/002; F41G 11/005; F41G 11/007; F41G 1/16; F41G 1/30; F41G 1/02

USPC ..... 42/113, 124, 127

See application file for complete search history.

(56) References Cited

U.S. PATENT DOCUMENTS

| | | | | |
|---|---|---|---|---|
| 4,628,611 | A | 12/1986 | Ruffino | |
| 4,799,325 | A * | 1/1989 | Booze | F41G 11/003 42/137 |
| 5,467,552 | A | 11/1995 | Cupp et al. | |
| 6,327,806 | B1 | 12/2001 | Paige | |
| 7,765,731 | B1 * | 8/2010 | Liebig | F41G 11/004 42/127 |
| 8,832,983 | B1 | 9/2014 | Wolf | |
| 8,893,422 | B2 | 11/2014 | Wolf | |
| 9,062,936 | B2 | 6/2015 | Zimmer | |
| 9,267,759 | B2 | 2/2016 | Speroni | |
| 9,506,726 | B2 | 11/2016 | Wolf | |
| 9,587,911 | B2 | 3/2017 | Wolf | |

(Continued)

OTHER PUBLICATIONS

ATEI, Works in Progress, Trijicon, Inc., Dec. 1, 2011 (one page).

(Continued)

*Primary Examiner* — Jonathan C Weber

(74) *Attorney, Agent, or Firm* — Eversheds Sutherland (US) LLP

(57) ABSTRACT

An assembly comprising a firearm slide and an adaptor plate configured to mate with the firearm slide. The adapter plate includes a first seat in a top surface of the adaptor plate and a second seat in the top surface of the adaptor plate. The assembly also includes a first iron sight configured to mate with the first seat and a second iron sight configured to mate with the second seat.

14 Claims, 11 Drawing Sheets

(56) References Cited

U.S. PATENT DOCUMENTS

| | | | |
|---|---|---|---|
| 10,024,628 | B2 | 7/2018 | Toner et al. |
| 10,036,613 | B2 | 7/2018 | Huff |
| RE47,335 | E | 4/2019 | Wolf |
| 10,352,654 | B2 | 7/2019 | Costet et al. |
| 10,663,254 | B1 | 5/2020 | Molcho |
| 10,753,710 | B2 | 8/2020 | Niswander et al. |
| 2013/0111799 | A1 | 5/2013 | Lee et al. |
| 2014/0150325 | A1 | 6/2014 | Keng et al. |
| 2014/0230305 | A1 | 8/2014 | Zimmer |
| 2015/0198415 | A1 | 7/2015 | Campean |
| 2015/0241175 | A1 | 8/2015 | Wolf |
| 2017/0059277 | A1 | 3/2017 | Justic |
| 2018/0087871 | A1 | 3/2018 | Toner |
| 2019/0049217 | A1 | 2/2019 | Costet et al. |
| 2019/0257620 | A1 | 8/2019 | Zimmer |
| 2020/0025520 | A1 | 1/2020 | Niswander et al. |

OTHER PUBLICATIONS

GW Leupold Deltapoint Cut, https://web.archive.org/web/20110104073915/http://www.glockworx.com:80/Products.aspx?CAT=3699, Jan. 2011 (3 pp.).

Matt, "Dueck Defense RBU", Sep. 26, 2015, Jerking the Trigger, Online Article, All Pages <https://jerkingthetrigger.com/2015/09/26/dueck-defense-rbu/>. (Year:2015).

Moden Weapon Concepts, "Pistol Red Dot Mounting Alternative: Dueck Defense RBU (Trijicon RMR)", Mar. 3, 2016, YouTube, Online Video, Entire Video, <https://www.youtube.com/watch?v=0Jdb0ohwMTc>. (Year: 2016).

* cited by examiner

SYSTEMS AND METHODS FOR ALTERNATING SIGHT ADAPTORS PLATES AND ASSOCIATED ACCESSORIES

CROSS-REFERENCE TO RELATED APPLICATIONS

The present application claims priority to, the benefit of, and is a continuation application of U.S. application Ser. No. 16/861,813, filed Apr. 29, 2020, which claims priority to and the benefit of U.S. Provisional Application No. 62/877,520, filed Jul. 23, 2019, which is hereby incorporated by reference herein in its entirety.

BACKGROUND

Reflector sights, also known as reflex sights, have become a large part of the firearm industry. Reflector sights offer a red dot or other illumination within the field of view of the sight. One potential issue with reflector sights is the possibility of the reflector sight dying during use because the electronics failed or the battery dies. Additionally, reflector sights can sometimes be difficult to use while shooting at close range targets. Therefore, finding optimal methods to co-witness a reflector sight with a traditional iron sight may decrease the likelihood of complete failure of the ability to sight a target and increase the preciseness of targeting objects at both close and long range.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Overview

The present disclosure is directed to systems and methods for an alternating sight adaptor plate assembly, which includes an alternating sight adaptor plate (also referred to herein as an adaptor plate) and an alternating iron sight (also referred to herein as an iron sight). The alternating sight adaptor plate assembly can also include a firearm slide with a recess configured to receive the alternating sight adaptor plate and a reflector sight configured to be secured onto the alternating sight adaptor plate. Each of the aforementioned components can be secured together to provide a firearm user a reflector sight and an iron sight in the line of sight along the firearm. For example, the firearm slide can include a recess by which the adaptor plate is configured to be secured thereto. The adaptor plate may include a joint and a pair of seats disposed along the top surface of the adaptor plate. The joint and the pair of seats are configured to secure a reflector sight and one or more iron sights (e.g., each seat can receive an iron sight to have multiple iron sights secured onto the adaptor plate) to the top surface of the adaptor plate. The iron sight(s) can slide within either of the seats, and the reflector sight can then be secured onto the joint by a complementary shaped sight base. The iron sight(s) are thereby secured between the sight base and the adaptor plate seat.

The disclosure now will be described more fully hereinafter with reference to the accompanying drawings, in which exemplary embodiments are shown. The concepts discussed herein may, however, be embodied in many different forms and should not be construed as limited to the examples set forth herein; rather, these examples are provided so that this disclosure will be thorough and complete, and will fully convey the scope to those of ordinary skill in the art. Like numbers refer to like, but not necessarily the same or identical, elements throughout.

Adaptor Plate

Figure 1A:
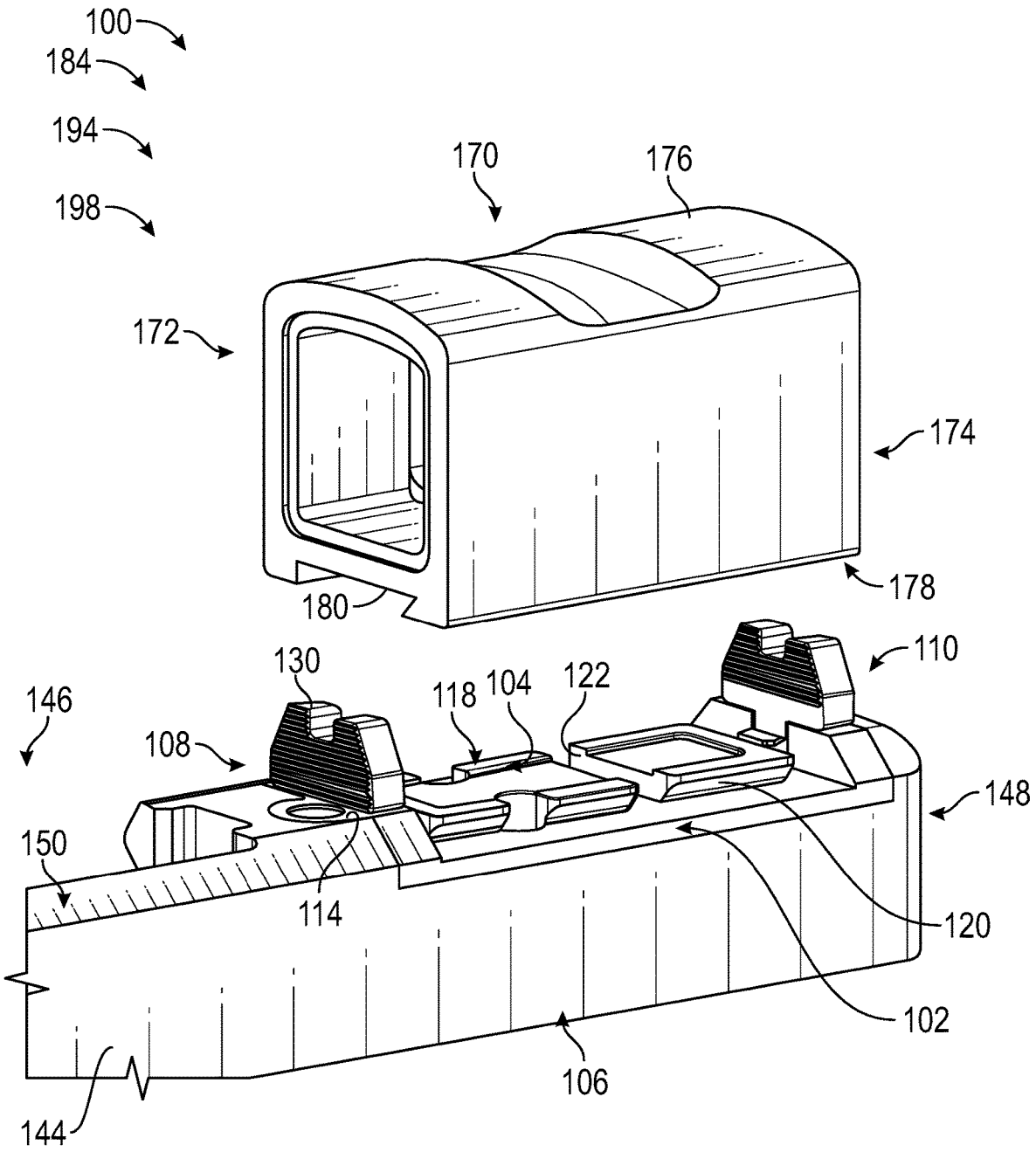
FIG. 1A is a perspective view of an alternating sight adaptor plate in an engaged position with a firearm slide, a reflector sight in an unsecured position and a set of iron sights in a seated position according to one or more embodiments of the disclosure.
Figure 1B:
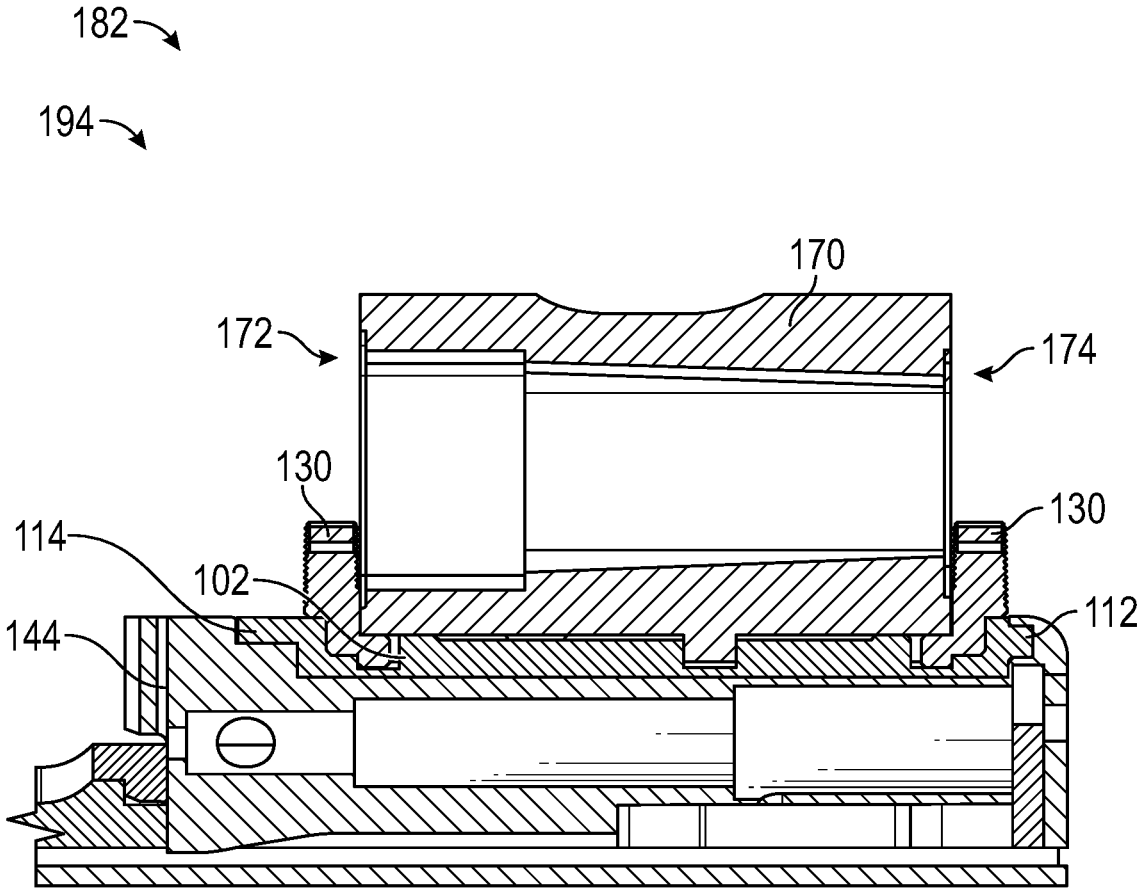
FIG. 1B is a cross-sectional view of the alternating sight adaptor plate, the secured reflector sight in a secured position, and the set of iron sights in the seated position according to one or more embodiments of the disclosure.
Figure 2A:
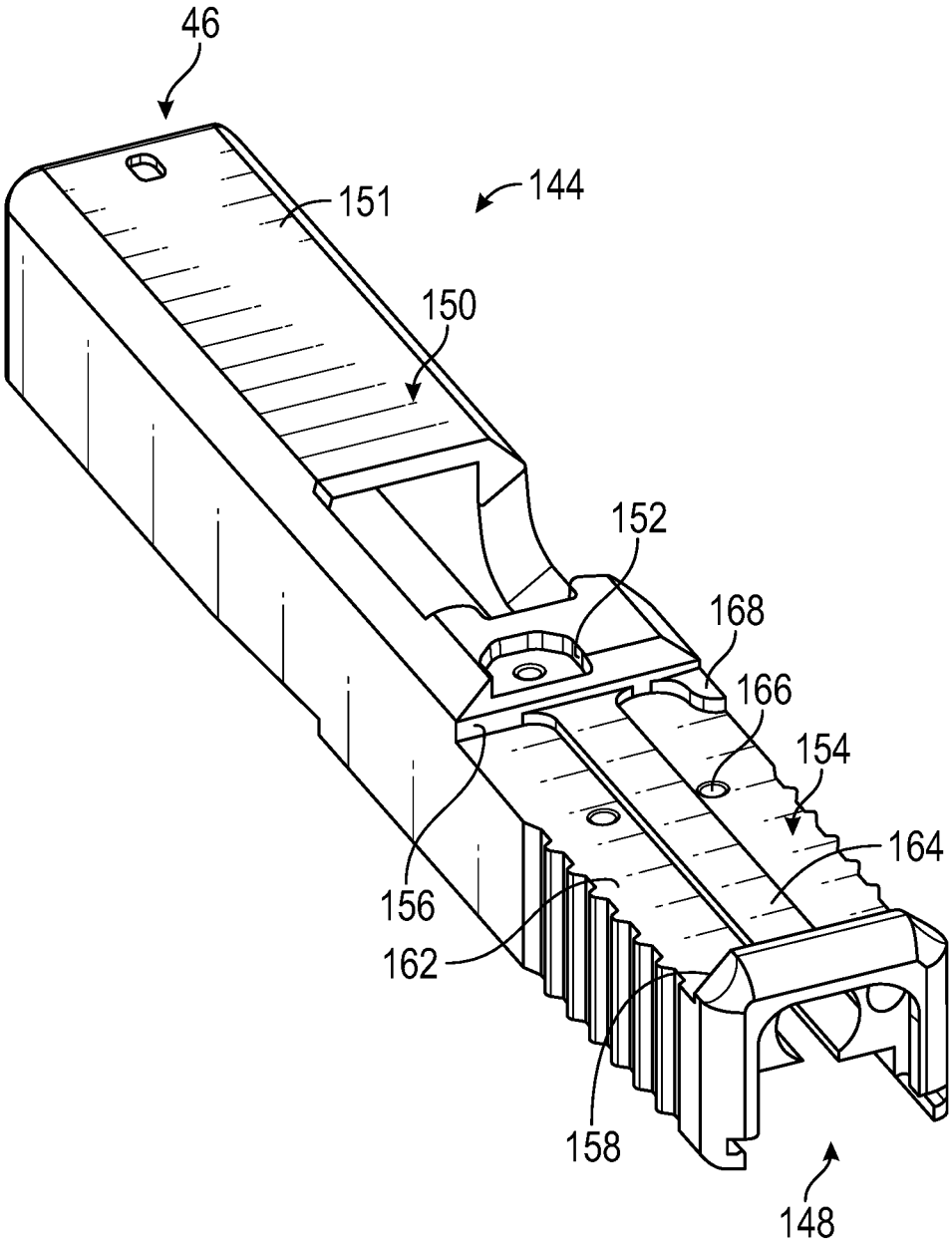
FIG. 2A is a rear perspective view of a firearm slide according to one or more embodiments of the disclosure.

FIGS. 1A-1B and 3A-3E depicts various views of an alternating sight adaptor plate 102 of an alternating sight adaptor plate assembly 100 configured to secure onto a firearm slide recess 154 (e.g., as shown in FIG. 2A). In one example, the alternating sight adaptor plate 102 includes a top surface 104, an opposed bottom surface 106, a front side 108, and a rear side 110. Each surface may be configured for several purposes, including temporarily or permanently attaching the alternating sight adaptor plate 102 to a firearm or reflector sight (e.g., as shown in FIG. 1B). As described below, the alternating sight adaptor plate 102 is configured to mount to a firearm slide 144. For example, the bottom surface 106 may be disposed within the recess 154 of the slide 102 and abut the base surface 115 of the recess 154. The alternating sight adaptor plate 102 enables a user to quickly change red dot sights and/or iron sights (and/or the configuration of the two (e.g., which is in front of the other)) on a firearm slide 144.

Figure 3A:
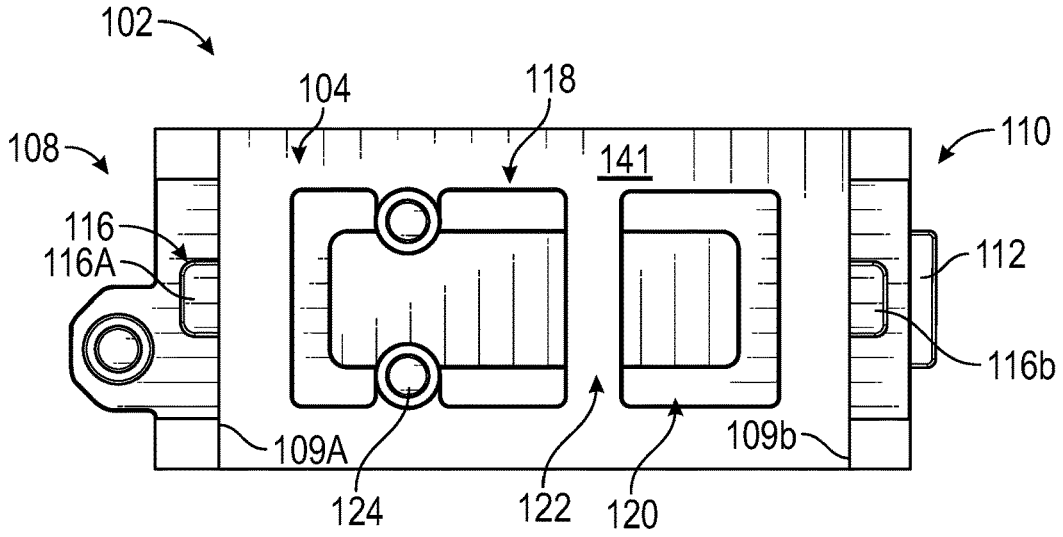
FIG. 3A is a top view of an alternating sight adaptor plate according to one or more embodiments of the disclosure.

FIG. 3A is a perspective view of the alternating sight adaptor plate 102 according to one example. The alternating sight adaptor plate 102 includes an anchor 114 disposed on the front side 108 and a stud 112 disposed on the rear side 110. As the alternating sight adaptor plate 102 is lowered into the recess 154, the stud 112 can enter the slot 160 disposed within the recess 154 thereby securing the rear side 110 of the plate. In some examples, the anchor 114 is configured to engage the catch 152 disposed on the firearm slide 144. Once engaged, the anchor 114 includes an aperture through which a fastener secures the anchor 114 into the firearm slide 144 by engaging the socket 166 in the catch 152. The anchor 114 and the stud 112 can thereby secure the alternating sight adaptor plate 102 within the recess 154 with or without an optic or iron sight attached to the alternating sight adaptor plate 102.

The alternating sight adaptor plate 102 can include an optic base surface 141 with engagement components such as a sight joint 118 and a plurality of apertures 124. In one example, the joint 118 is along the top surface 104 of the adaptor plate 102, between the first plate wall 109A and the second plate wall 109B. The joint 118 can be an elevated surface extending away from the top surface 104 of the adaptor plate 102. The joint 118 can include a set of joint sidewalls 120 that extend at an angle to the top surface 104 to form a male dovetail. For example, the angle of the joint sidewalls 120 can be 45 degrees to the top surface. In other examples, the angle of the joint sidewalls 120 can be between 1-179 degrees to the top surface. The joint sidewalls 120 are configured to receive a corresponding female dovetail of the reflector sight base 180 (e.g., as shown in FIG. 1B). The joint 118 can include a sight channel 122 extending through the joint 118. The sight channel 122 can include two parallel sidewalls and a floor. The alternating sight adaptor plate 102 can include a plurality of apertures 124 disposed through the joint 118 from the top surface 104 to the bottom surface 106. The plurality of apertures 124 can be disposed anywhere along the top surface of the adaptor plate 102.

In some examples, the alternating sight adaptor plate 102 can include a pair of seats 116A/116B on and recessed in the plate walls 109A/109B. That is, a first seat 116A is disposed on the first plate wall 109A, and a second seat 116B is disposed on the second plate wall 109B. The first seat 116A and the second seat 116B can be a shortened channel within the first plate wall 109A and the second plate wall 109B, respectively. In some instances, the seats 116A/116B are substantially rectangular. Each are complementary to the leg(s) on the iron sight (e.g., as shown in FIGS. 4A-4D). The seats 116A/116B may be any other suitable shape to complement the leg(s).

In some examples, the alternating sight adaptor plate 102 is substantially rectangular. In some instances, the plate walls 109A/109B can be at a 90-degree angle to the optic base surface 141. One or both of the plate walls 109A/109B can be straight or curved. In one example, the second plate wall 109B is a rectangular planar shape and the first plate wall 109A is a curved rectangular shape. In other examples, the plate walls 109A/109B may be triangular, circular, pyramidal, trapezoidal, or some other suitable shape or combination of shapes. In other examples, the alternating sight adaptor plate 102 may be a different shape. For example, the plate walls 109A/109B may have an angle to the optic base surface 141 ranging from 1 degree to 179 degrees. The plate walls 109A/109B may be at the same or different angles from the optic base surface 141.

Figure 3B:
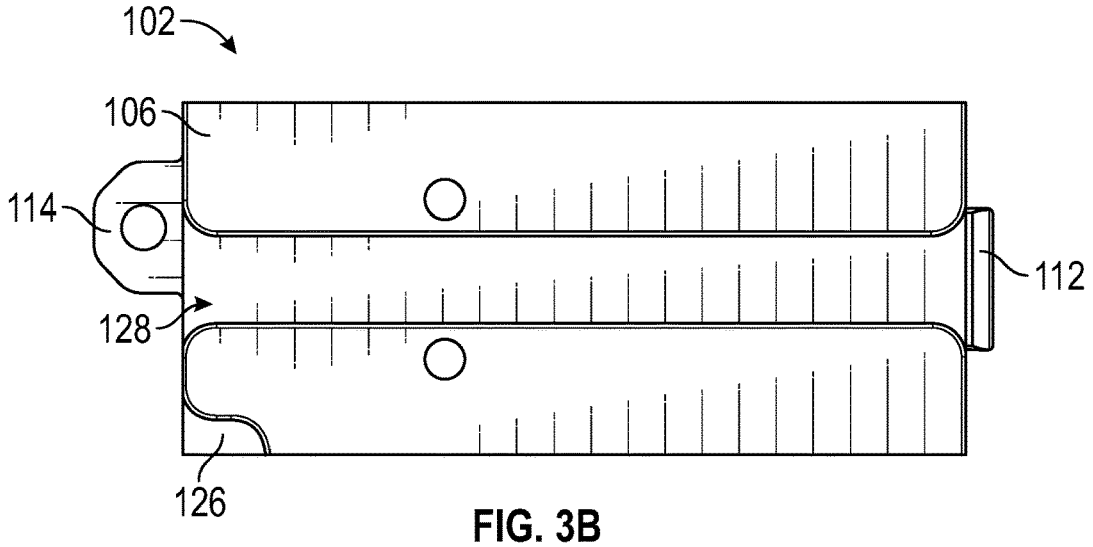
FIG. 3B is a bottom view of the alternating sight adaptor plate according to one or more embodiments of the disclosure.
Figure 3C:
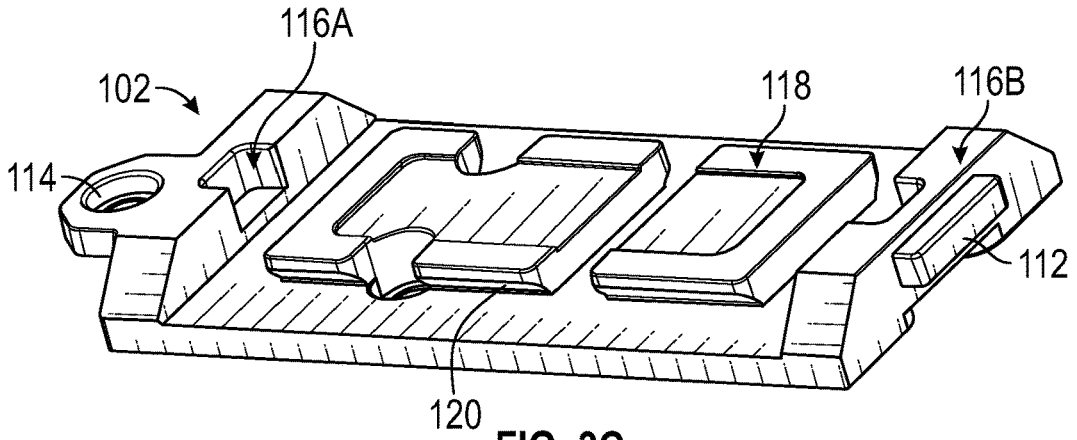
FIG. 3C is a rear perspective view of the alternating sight adaptor plate according to one or more embodiments of the disclosure.
Figure 3D:
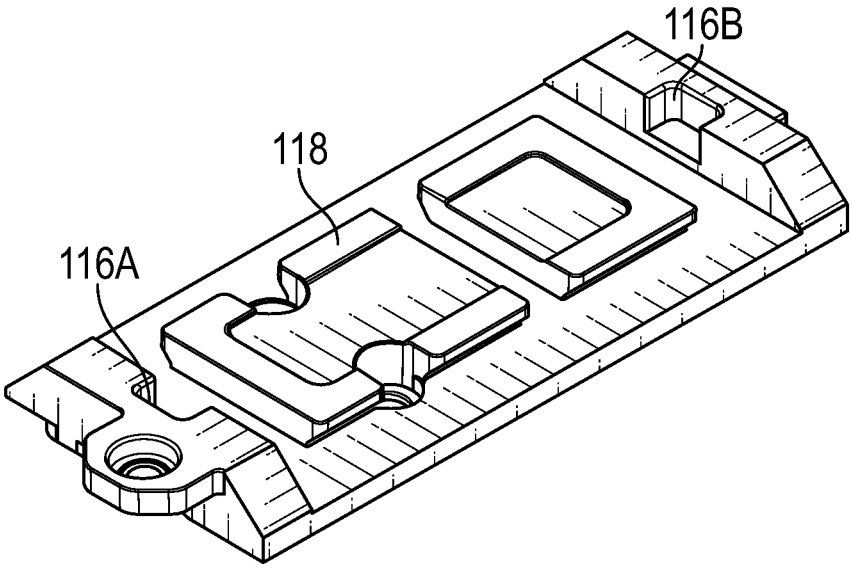
FIG. 3D is a front perspective view of the alternating sight adaptor plate according to one or more embodiments of the disclosure.
Figure 3E:
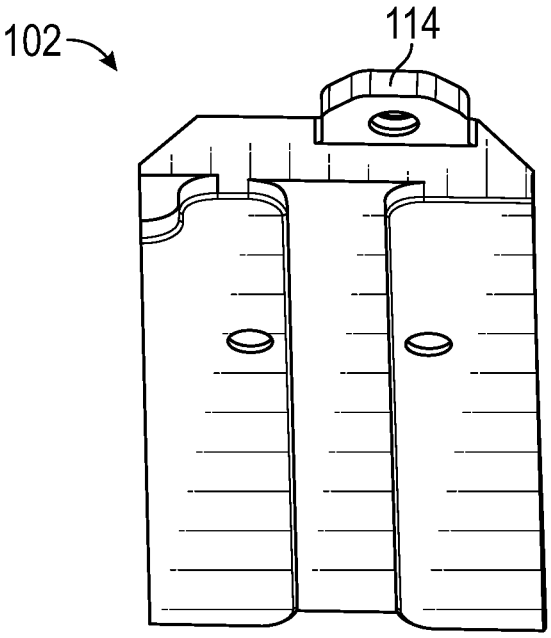
FIG. 3E is a bottom front perspective view of the alternating sight adaptor plate according to one or more embodiments of the disclosure.

Referring to FIG. 3B, the alternating sight adaptor plate 102 can include an ejector notch 126 and a rib channel 128 on the bottom surface 106 configured to engage the firearm slide recess 154. In one example, the ejector notch 126 complements the shape of the ejector projection 168 disposed within the recess 154. Similarly, the rib channel 128 can complement the shape of the rib 164 disposed within the recess 154. Both the ejector notch 126 and the rib channel 128 can slideably engage the ejector projection 168 and the rib 164, respectively. In some examples, the ejector notch 126 can be disposed adjacent to the front side 108. The rib channel 128 can extend from the front side 108 to the rear side 110. In other examples, the ejector notch 126 and the rib channel 128 can be disposed or extend along any portion of the alternating sight adaptor plate 102.

In some examples, the apertures 124 are flush with the top surface 104 of the alternating sight adaptor plate 102 or may protrude in other suitable directions. For example, the plurality of apertures 124 may protrude from the bottom surface 106 of the alternating sight adaptor plate. The plurality of apertures 124 may protrude or be flush with any other surface of the alternating sight adaptor plate 100. Each of the apertures 124 can include a threaded interior. The threaded interior accepts a fastener configured to secure the alternating sight adaptor plate 102 to the firearm slide 144. In some examples, the apertures 124 are sized to accept an eight gauge, 40 thread per inch screw. The screw may include Loctite® screw glue on the surface to secure the alternating sight adaptor plate 102. In other instances, the plurality of apertures 124 may accept different sized screws or other fasteners. For example, the plurality of apertures 124 may accept screw sizes from a 0 gauge to a 24 gauge screw. The screws and the complementary threading within the plurality of apertures may have a thread count of 1-100 threads per inch of the surface. The apertures 124 may be disposed on any of the examples described herein. The apertures 124 may be disposed on the optic plate surface 141 and/or the anchor 114.

Alternating Iron Sight

Figure 4A:
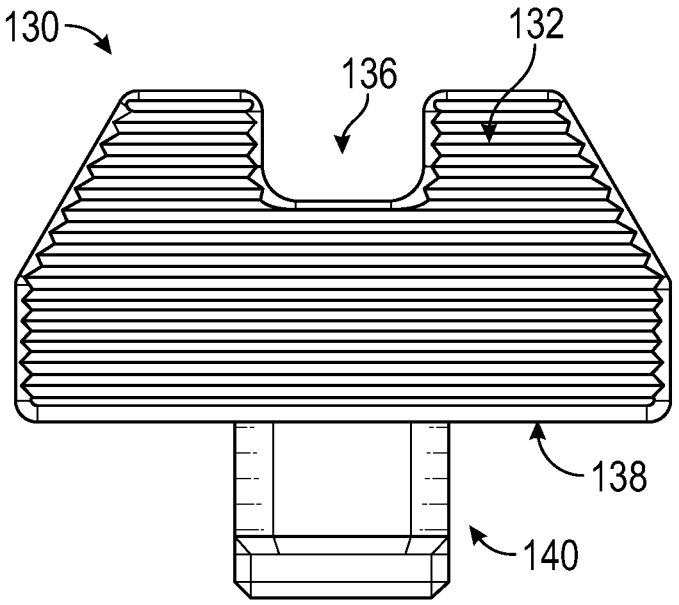
FIG. 4A is a front view of an alternating iron sight according to one or more embodiments of the disclosure.
Figure 4B:
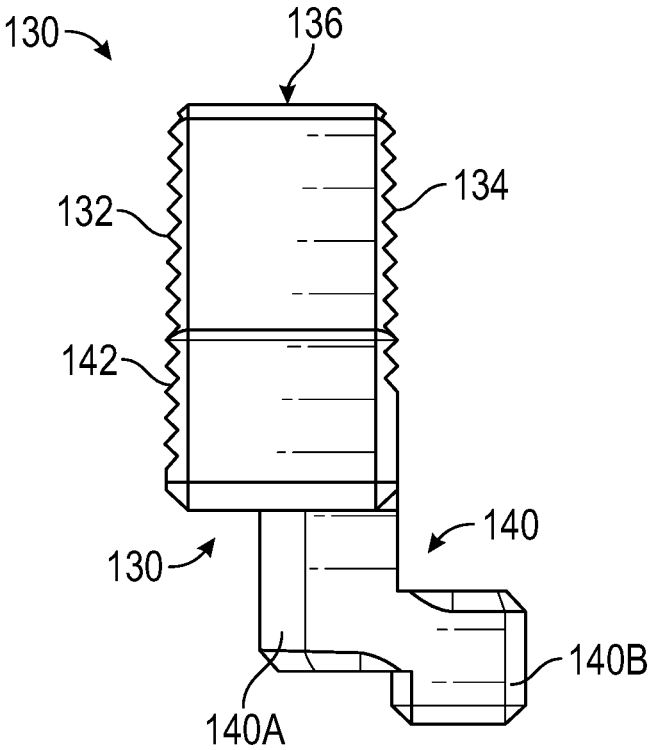
FIG. 4B is a side view of the alternating iron sight according to one or more embodiments of the disclosure.
Figure 4C:
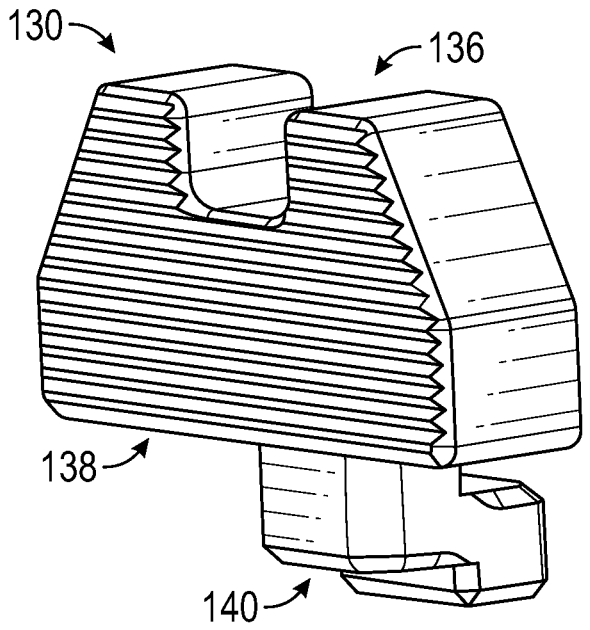
FIG. 4C is a right side view of the alternating iron sight according to one or more embodiments of the disclosure.
Figure 4D:
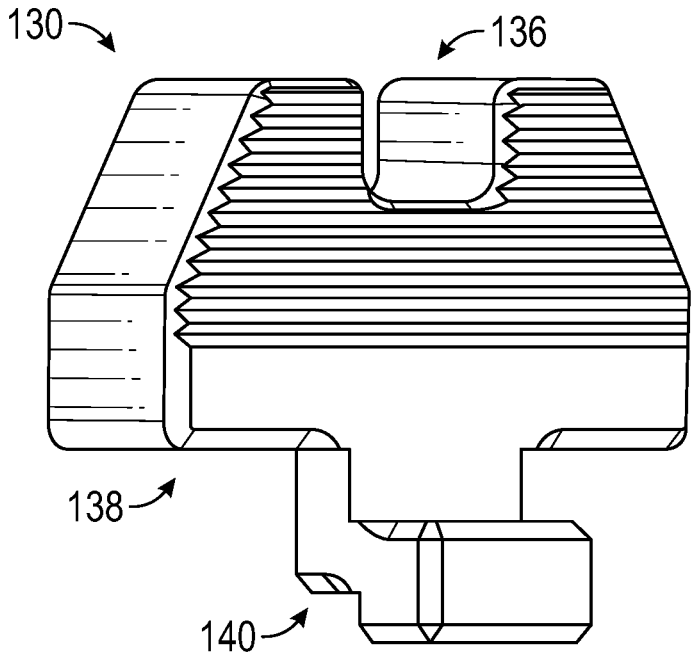
FIG. 4D is a left side view of the alternating iron sight according to one or more embodiments of the disclosure.

FIG. 4A is a front view of an alternating iron sight according to one or more embodiments of the disclosure. FIG. 4B is a side view of the alternating iron sight according to one or more embodiments of the disclosure. FIG. 4C is a right side view of the alternating iron sight according to one or more embodiments of the disclosure. FIG. 4D is a left side view of the alternating iron sight according to one or more embodiments of the disclosure. Referring to FIGS. 4A-4D, the alternating iron sight 130 includes a first side 132, a second side 134, a top side 136, and a bottom side 138. In some examples, the iron sight 130 includes a pair of legs 140 extending from the bottom side 138 of the iron sight 130. The pair of legs 140 can be substantially rectangular. In other instances, the pair of legs 140 can be any other suitable geometric shape. That is, a first leg 140A is attached to the bottom side 138 and extends in a lateral direction away from the bottom side 138. A second leg 140B extends substantially perpendicular to the first leg 140A. The first leg 140A and the second leg 140B may extend in any variety of angles away from the bottom side 138 of the iron sight 130. The first leg 140A is configured to slide within one of the pair of seats 116A/116B of the adaptor plate 102. The second leg 140B protrudes outward towards the joint 118. In this manner, when the reflector sight 170 is placed onto the joint 118, the pair of legs 140 and sandwiched between the reflector sight 170 and the adaptor plate 102 so as to anchor the iron sight 130 within the seat 116. In some instances, the alternating iron sight 130 includes a textured (e.g., knurled, frictional, etc.) surface 142 along the first side 132 and the second side 134. The textured surface 142 may be disposed along any number of other surfaces. Along the top side 136 of the iron sight 130, a substantially u-shaped channel (or sight portion) can be disposed thereon. As seen in the art, the sight portion of an iron sight can be any shape.

Firearm Slide

Figure 2B:
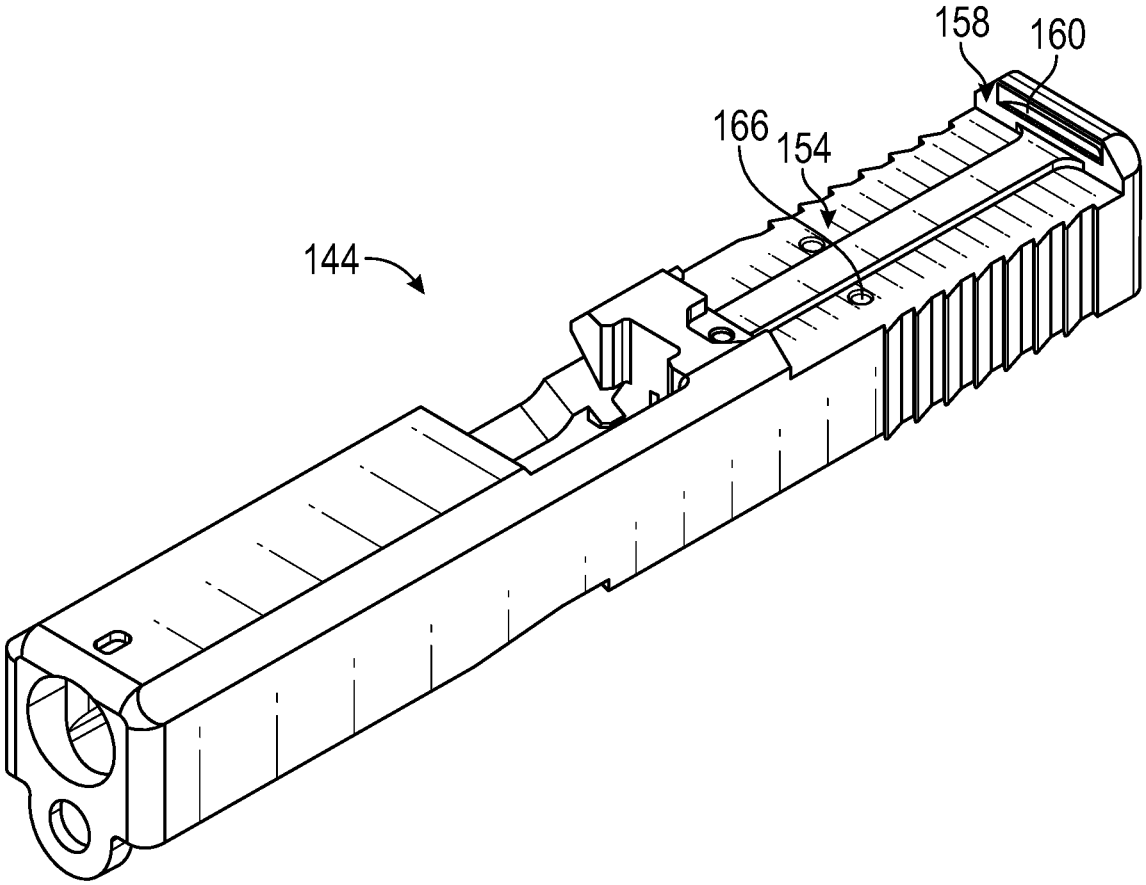
FIG. 2B is a front perspective view of the firearm slide according to one or more embodiments of the disclosure.
Figure 2C:
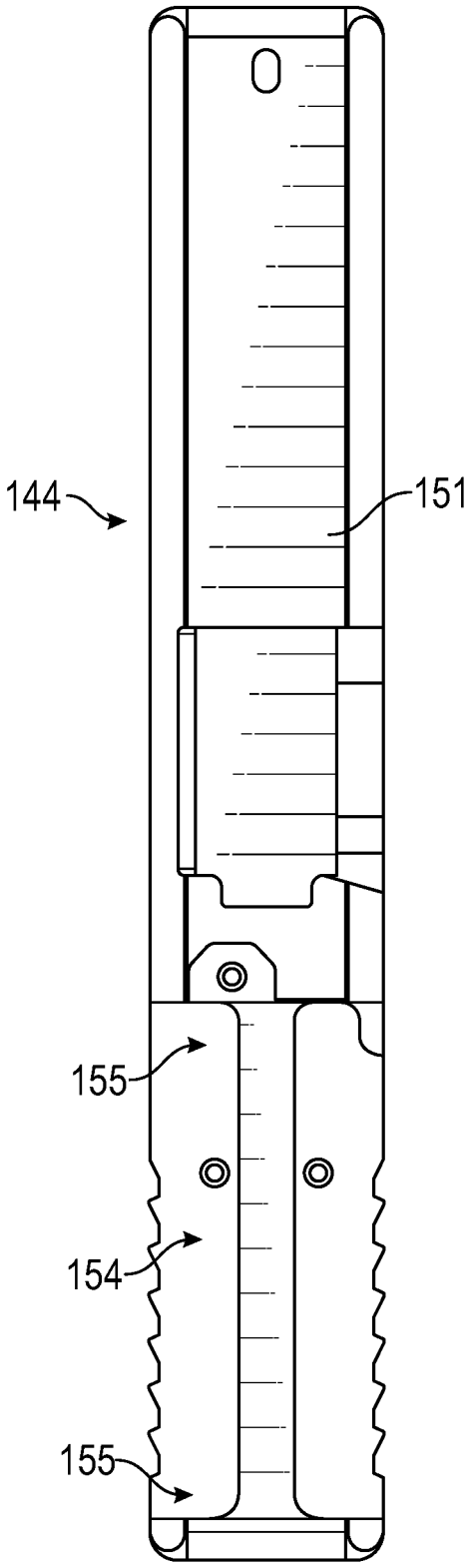
FIG. 2C is a top view of the firearm slide according to one or more embodiments of the disclosure.

FIG. 2A is a rear perspective view of a firearm slide according to one or more embodiments of the disclosure. FIG. 2B is a front perspective view of the firearm slide according to one or more embodiments of the disclosure. FIG. 2C is a top view of the firearm slide according to one or more embodiments of the disclosure. Referring to FIGS. 2A-2C, a firearm slide 136 has a recess 154 configured to accept an alternating sight adaptor plate assembly 100. In certain examples, the firearm slide 144 includes an exterior surface 151 with a muzzle end 146 and a butt end 148. On a top slide side 150 of the firearm slide 144, between the muzzle end 146 and the butt end 148, the recess 154 is disposed towards the butt end 148. The recess 154 can be a recessed surface along the plane of the top slide side 150 of the firearm slide 144.

The recess 154 of the firearm slide 144 includes a pair of slide walls 155 (e.g., a first slide wall 156 and a second slide wall 158) disposed opposite to one another. In one example, the slide walls 156/158 are parallel to one another and form a rectangular indention with the recess 154. Adjacent to the first slide wall 156 is a catch 152. The catch 152 can be an indented surface to the firearm slide 144 similar to the recess 154. The catch 152 may be disposed below the top surface of the firearm and above the recess 154. The catch 152 can be substantially semi-circular in some instances. In other instances, the catch 152 can be rectangular, triangular, or some other geometric shape. The catch 152 can be offset from the center along the exterior surface 151. The catch 152 may be centered along the exterior surface 151.

Adjacent to the catch 152 and extending to the second slide wall 158 can be a rib 164 disposed within the recess 154. The rib 164 can run between the first slide wall 156 and the second slide wall 158. The rib 164 can be a raised surface from a recess base surface 162 configured to correspond to a later discussed surface of an alternating sight adaptor plate 102. In other examples, the rib 164 may extend in a variety of other directions and/or take other shapes, such as a square, circle, triangle, etc., or a combination of shapes.

Adjacent to the rib 164, and disposed on the second slide wall 158, can be a slot 160. The slot 160 can be an indented surface disposed into the second slide wall 158. In other examples, the rib 164, the slot 160, and the catch 152 can be interchangeably disposed on or between the first slide wall 156 and the second slide wall 158.

In some examples, the recess 154 can include an ejector projection 168 and one or more sockets 166 disposed in the recess 154. The ejector projection 168 can be adjacent to the rib 164, and in some instances, similar to the rib 164. The ejector projection 168 can mimic a later discussed surface of the alternating sight adaptor plate 102. For example, the ejector projection 168 may fit within a complementary ejector notch 126 on the bottom surface 106 of the alternating sight adaptor plate 102. Each the rib 164 and the ejector projection 168 can stabilize the alternating sight adaptor plate 102 so as to disallow lateral movement whether the firearm is discharged or is static. Additionally, an advantage of the rib 164 and the ejector projection 168 can be to help to align the alternating sight adaptor plate 102 between the muzzle end 146 and the butt end 148 of the firearm slide 144. The rib 164 may be raised at a variety of heights from the base surface 115 of the recess 154 of the firearm slide 144. In some instances, the rib 164 may be raised above the recess 154 to protect the striker channel within the firearm slide 144. In other examples, the rib 164 can be omitted.

In some examples, the sockets 166 can be disposed throughout and adjacent to the recess 154. The sockets 166 can be configured to receive one or more fasteners (e.g., threaded). For example, as shown in FIG. 2A, the recess 154 and the catch 152 can include one or more sockets 166. The recess 154 can have a socket 166 disposed on each side of the rib 164, and the catch 152 can have a socket 166 disposed on one surface. In this manner, once the alternating sight adaptor plate 102 is set within the recess 154, one or more fasteners can engage each socket 166 through the alternating sight adaptor plate 102.

In some instances, the recess 154 can be substantially rectangular. For example, the two opposed slide walls 156/158 extend at a 90-degree angle from the recess base surface 162 towards the top side 136 of the firearm slide 144. In other examples, the recess 154 may be circular, triangular, or some other geometric shape. The slide walls 156/158 may angle from the recess base surface 162 between 1 degree to 179 degrees. In other examples, the slide walls 156/158 may include an arced surface. The slide walls 156/158 may be at the same angle. In some instances, the recess base surface 162 may be parallel (or co-planar) with the barrel hood of the firearm along the top side of the firearm slide 144. In other instances, the recess base surface 162 may be angled towards or away from the barrel hood of the firearm.

Positioning Assembly

Figure 5:
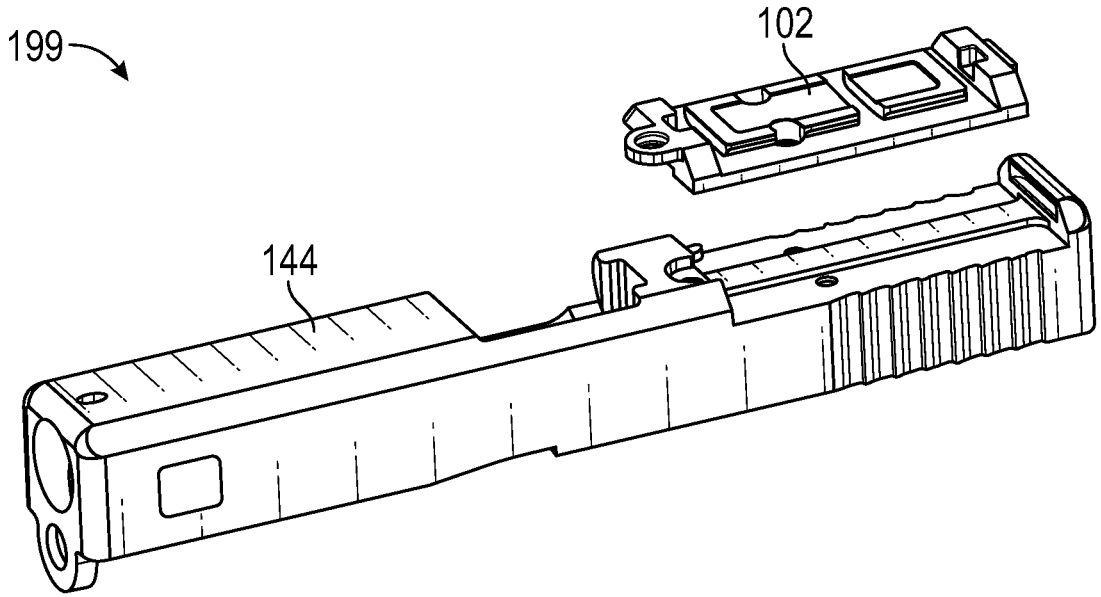
FIG. 5 is a perspective view of a slide and an alternating sight adaptor plate in a disengaged position according to one or more embodiments of the disclosure.
Figure 6A:
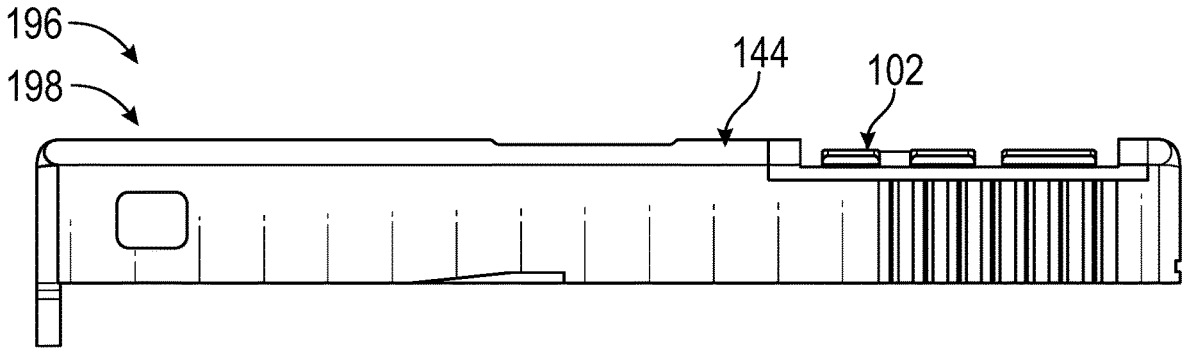
FIG. 6A is a left side view of the alternating sight adaptor plate in an engaged position with a firearm slide according to one or more embodiments of the disclosure.
Figure 6B:
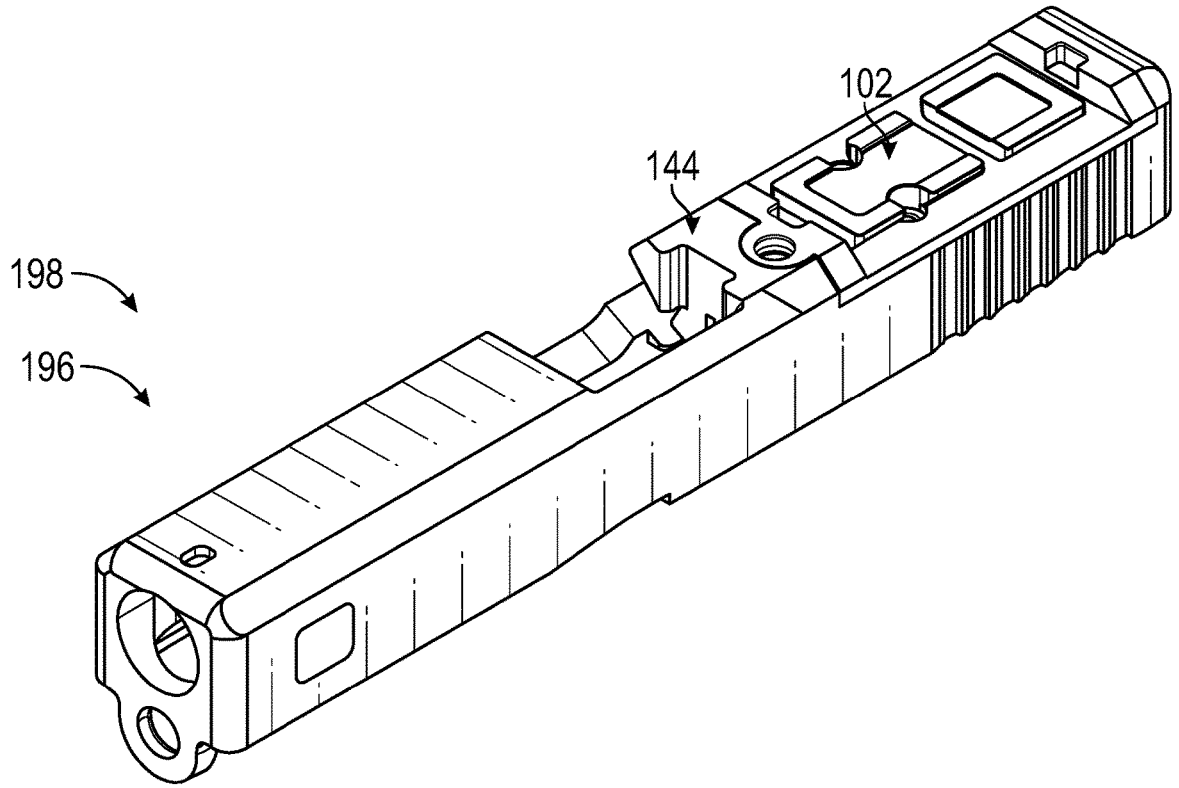
FIG. 6B is a perspective view of the alternating sight in the engaged position with the firearm slide according to one or more embodiments of the disclosure.

As shown between FIGS. 1A and 1B, the alternating sight adaptor plate assembly 100 can alter between a disengaged position 199 and an engaged position 172. In the disengaged position 199 (e.g., as shown in FIG. 5), the alternating sight adaptor plate 102 can lower into the recess 154 to secure onto the slide 102 (e.g., into the engaged position 198 as shown in FIGS. 6A-6B). FIG. 1B depicts the engaged position 172 of the alternating sight adaptor plate 102 and the slide 102.

As shown in in FIGS. 1A and 1B, the alternating iron sight 130 can slide within one of the seats 116 to be in a seated position 194. In the seated position 194, the reflector sight 170 can then slide onto the joint 118 to secure the alternating iron sight 130 in place in the seated position 194. The pair of seats 116 can both secure an alternating iron sight 130 or either the first seat 116A or the second seat 116B can secure one iron sight 130.

As shown in FIG. 1B, the reflector sight 170 can lower onto the joint 118 into a secured position 182. For example, as shown in FIG. 1A, the reflector sight 170 is in the unsecured position 184. The reflector sight base 180 could actuate onto the joint 118. In other examples, the reflector sight base 180 can slide onto the joint 118. The reflector sight 170 can include a sight front side 172, a sight rear side 174, a sight top side 176, and a sight base side 178. As shown in FIG. 1B, the reflector sight bottom base side 178 abuts the joint 118. In some instances, when an iron sight 130 is disposed in one of the pair of seats 116, the reflector sight 170 secures the iron sight(s) 130 into one or both seats 116A/116B when the reflector sight 170 is in the secured position 182.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A sight adaptor plate assembly, comprising:
an adaptor plate comprising
a stud integral with and extending from the adaptor plate,
an anchor integral with and extending from the adaptor plate, and
a seat in a top surface of the adaptor plate; and
an iron sight comprising a leg configured to mate with the seat,
wherein the seat comprises a first seat disposed on a front side of the adapter plate and a second seat disposed on a rear side of the adapter plate.

2. The sight adaptor plate assembly of claim 1, further comprising a reflector sight configured to be attached to the adapter plate.

3. The sight adaptor plate assembly of claim 1, wherein the leg comprises:
a first leg portion extending from a bottom side of the iron sight; and
a second leg portion extending from the first leg portion.

4. The sight adaptor plate assembly of claim 1, wherein the iron sight is positionable within the first seat or the second seat.

5. The sight adaptor plate assembly of claim 1, wherein the iron sight comprises a first iron sight configured to mate with the first seat and a second iron sight configured to mate with the second seat.

6. The sight adaptor plate assembly of claim 1, further comprising a firearm slide configured to mate with the adapter plate.

7. The sight adaptor plate assembly of claim 6, wherein the firearm slide comprises:
a recess configured to receive the adaptor plate;
a catch configured to mate with the anchor; and
a slot configured to mate with the stud.

8. An assembly, comprising:
a firearm slide;
an adaptor plate configured to mate with the firearm slide, wherein the adapter plate comprises a first seat in a top surface of the adaptor plate and a second seat in the top surface of the adaptor plate;
a first iron sight configured to mate with the first seat; and
a second iron sight configured to mate with the second seat.

9. The assembly of claim 8, further comprising a reflector sight configured to be attached to the adapter plate.

10. The assembly of claim 8, wherein the adaptor plate comprises a stud and an anchor.

11. The assembly of claim 10, wherein the firearm slide comprises:
a recess configured to receive the adaptor plate;
a catch configured to mate with the anchor; and
a slot configured to mate with the stud.

12. A method, comprising:
providing an adaptor plate comprising
a stud integral with and extending from the adaptor plate,
an anchor integral with and extending from the adaptor plate, and
a seat in a top surface of the adaptor plate; and
providing an iron sight comprising a leg configured to mate with the seat,
wherein the seat comprises a first seat disposed on a front side of the adapter plate and a second seat disposed on a rear side of the adapter plate, and wherein the iron sight comprises a first iron sight configured to mate with the first seat and a second iron sight configured to mate with the second seat.

13. The method claim 12, further comprising providing a reflector sight configured to be attached to the adapter plate.

14. The method of claim 12, further comprising providing a firearm slide configured to mate with the adapter plate.

* * * * *